US006052905A

United States Patent [19]

Branchinelli et al.

[11] Patent Number: 6,052,905

[45] Date of Patent: Apr. 25, 2000

[54] DUAL SCULPTOR RETRACTABLE RAZOR

[76] Inventors: Anthony Branchinelli, 156-37 87th St., Howard Beach, N.Y. 11414; Michael Donnarumma, Jr., 182 Bayside Dr., Atlantic Beach, N.Y. 11509

[21] Appl. No.: 09/221,682

[22] Filed: Jan. 2, 1999

[51] Int. Cl.[7] ..... B26B 21/00

[52] U.S. Cl. ..... 30/50; 30/34.1; 30/47; 30/48; 30/526

[58] Field of Search ..... 30/50, 47, 48, 30/51, 57, 62, 66, 526, 527, 532, 299, 34.1

[56] References Cited

U.S. PATENT DOCUMENTS

| | | | |
|---|---|---|---|
| 2,349,252 | 5/1944 | Douglas | 30/47 X |
| 2,587,964 | 3/1952 | Burns | 30/50 X |
| 4,461,078 | 7/1984 | Carreker | 30/47 |
| 4,989,328 | 2/1991 | Sokoloff | 30/34.1 |
| 4,993,153 | 2/1991 | Henry | 30/50 |
| 5,426,853 | 6/1995 | McNinch | 30/48 X |
| 5,911,480 | 6/1999 | Morgan | 30/526 X |

FOREIGN PATENT DOCUMENTS

| | | | |
|---|---|---|---|
| 1294666 | 11/1972 | United Kingdom | 30/FOR 100 |

*Primary Examiner*—Rinaldi I. Rada
*Assistant Examiner*—Boyer Ashley
*Attorney, Agent, or Firm*—Michael I. Kroll

[57] ABSTRACT

A razor for shaving and sculpting an area of hair on a user. The razor includes a first standard size razor head, a second narrow size razor head including a telescopic member extending therefrom and a handle including a top side integrally connected to the first standard size razor head; a first recess extending through the top side and into the handle forming a compartment; and a second recess extending along a length of the handle and providing access to the compartment. The telescopic member is received by the compartment and is slideable therein. A slideable member is connected to the telescopic member and extends through the second recess for sliding the telescopic member within the compartment whereby movement of the slideable member moves the second narrow size razor head between a first extended position in which the telescopic member extends substantially totally from the compartment and a second retracted position in which the telescopic member is substantially completely received within the compartment. Alternatively, the second narrow size razor head may also be integrally connected to the handle. Finally, the narrow size razor head may also be connected to an elongated handle by itself.

12 Claims, 13 Drawing Sheets

DUAL SCULPTOR RETRACTABLE RAZOR

BACKGROUND OF THE INVENTION

1. Field of the Invention

The present invention relates generally to razor, more specifically, to a razor including a first standard razor head and a second narrow razor head whereby the second razor head may be retractably connected to a handle of the razor.

2. Description of the Prior Art

Numerous types of razors have been provided in the prior art. For example, U.S. Pat. Nos. 4,501,066; 5,222,300; 5,307,564 and 5,526,567 all are illustrative of such prior art. While these units may be suitable for the particular purpose to which they address, they would not be as suitable for the purposes of the present invention as heretofore described.

U.S. Pat. No. 4,501,066

Inventor: Conrad T. Sceberras

Issued: Feb. 26, 1985

Disclosed is a dual headed razor system having a handle supporting a pair of separately detachable razor heads respectively useful in shaving forwardly and rearwardly in to and fro strokes. The identical razor heads are usable interchangeably and are telescopically supported crosswise of the handle.

U.S. Pat. No. 5,222,300

Inventor: Althaus et al.

Issued: Jun. 29, 1993

A razor head, especially a razor blade unit of a wet razor, with the razor head being disposed at the front end of a handle. A single or double razor blade is yieldingly mounted in a plastic housing. To improve the spring or yielding mounting of the single or double razor blades, the latter are secured to a blade member that is mounted on a four-pivot articulation arrangement. This arrangement is provided with two swivel levers, each of which is pivotably between the plastic housing and the blade member on pivot points that have axes that extend parallel to the cutting edges of the razor blades. The swivel levers are pivotable against a spring force.

U.S. Pat. No. 5,307,564

Inventor: Frederic D. Schoenberg

Issued: May 3, 1994

A safety razor having two independent separate shaving heads for shaving with and against the grain by pulling the handle of the razor across a working surface, then turning the handle about its longitudinal axis and using the other head by pushing the handle to shave against the grain. The shaving head used by pulling is mounted at an angle with respect to the handle and the head used by pushing is mounted substantially parallel to the handle.

U.S. Pat. No. 5,526,567

Inventor: William C. Carson III et al.

Issued: Jun. 18, 1996

A shaving system includes a platform member with a support surface that has a plurality of apertures therein and guard structure integral therewith and disposed forwardly of the support surface, a cap member with a plurality of post elements for disposition in the apertures in the support structure, a prim blade member having a planar body and a cutting edge, a secondary blade member having a planar body and a cutting edge, each blade member having a plurality of apertures and at least two of the apertures having spaced locating surfaces for positioning engagement with the post elements, and a plurality of discreet spacer members disposed on the post elements and between the primary and secondary blade members. The post elements extend through the apertures in the blade members, the spacers and the platform member and preferably are mechanically deformed to secure the primary and secondary blade members with their cutting edges in spaced parallel relation in a fixed shaving geometry. The spacer members maintain predetermined vertical spacing between the cutting edges of the primary and secondary blade members and the post elements maintain predetermined lateral spacing of the blade edges of the primary and secondary blade members relative to the guard structure.

SUMMARY OF THE PRESENT INVENTION

The present invention relates generally to razors and, more specifically, to a razor including a first standard razor head and a second narrow razor head whereby the second razor head may be retractably connected to a handle of the razor.

A primary object of the present invention is to provide a razor that will overcome the shortcomings of prior art devices.

A further object of the present invention is to provide a razor which is able to both sculpt facial hair and shave sensitive areas of the skin.

Another object of the present invention is to provide a razor including a first standard razor head and a second narrow razor head extending from a common handle.

A further object of the present invention is to provide a razor wherein the second razor head is retractably connected within the handle.

A yet further object of the present invention is to provide a razor wherein the handle includes a compartment for receiving the second razor head when the second razor head is in its retracted position.

A still further object of the present invention is to provide a razor including a manually activated clip for retracting and extending the second razor head.

A further object of the present invention is to provide a razor wherein the first razor head is of standard size for shaving the hair of the user and the second razor head is more narrow than the first razor head for shaving particular sensitive areas such as the nose, ears and mustaches and for sculpting other areas of hair.

Another object of the present invention is to provide a razor that is simple and easy to use.

A still further object of the present invention is to provide a razor that is economical in cost to manufacture.

Additional objects of the present invention will appear as the description proceeds.

A razor for shaving and sculpting an area of hair on a user is disclosed by the present invention. The razor includes a first standard size razor head, a second narrow size razor head including a telescopic member extending therefrom and a handle including a top side integrally connected to the first standard size razor head; a first recess extending through the top side and into the handle forming a compartment; and a second recess extending along a length of the handle and providing access to the compartment. The telescopic member is received by the compartment and is slideable therein. A slideable member is connected to the telescopic member and extends through the second recess for sliding the telescopic member within the compartment whereby movement of the slideable member moves the second narrow size razor head between a first extended position in which the telescopic member extends substantially totally from the compartment and a second retracted position in which the telescopic member is substantially completely received within the compartment. Alternatively, the second narrow size razor head may also be integrally connected to the handle.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 2:
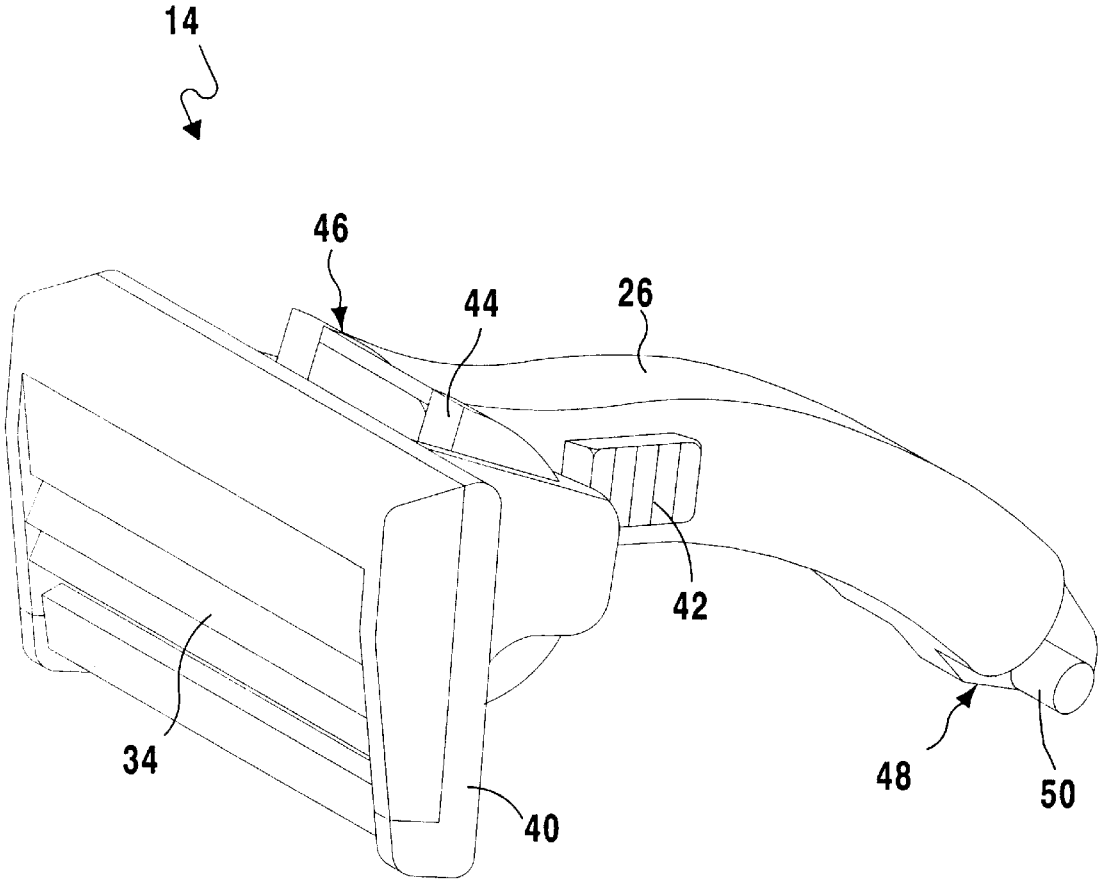
Figure 3:
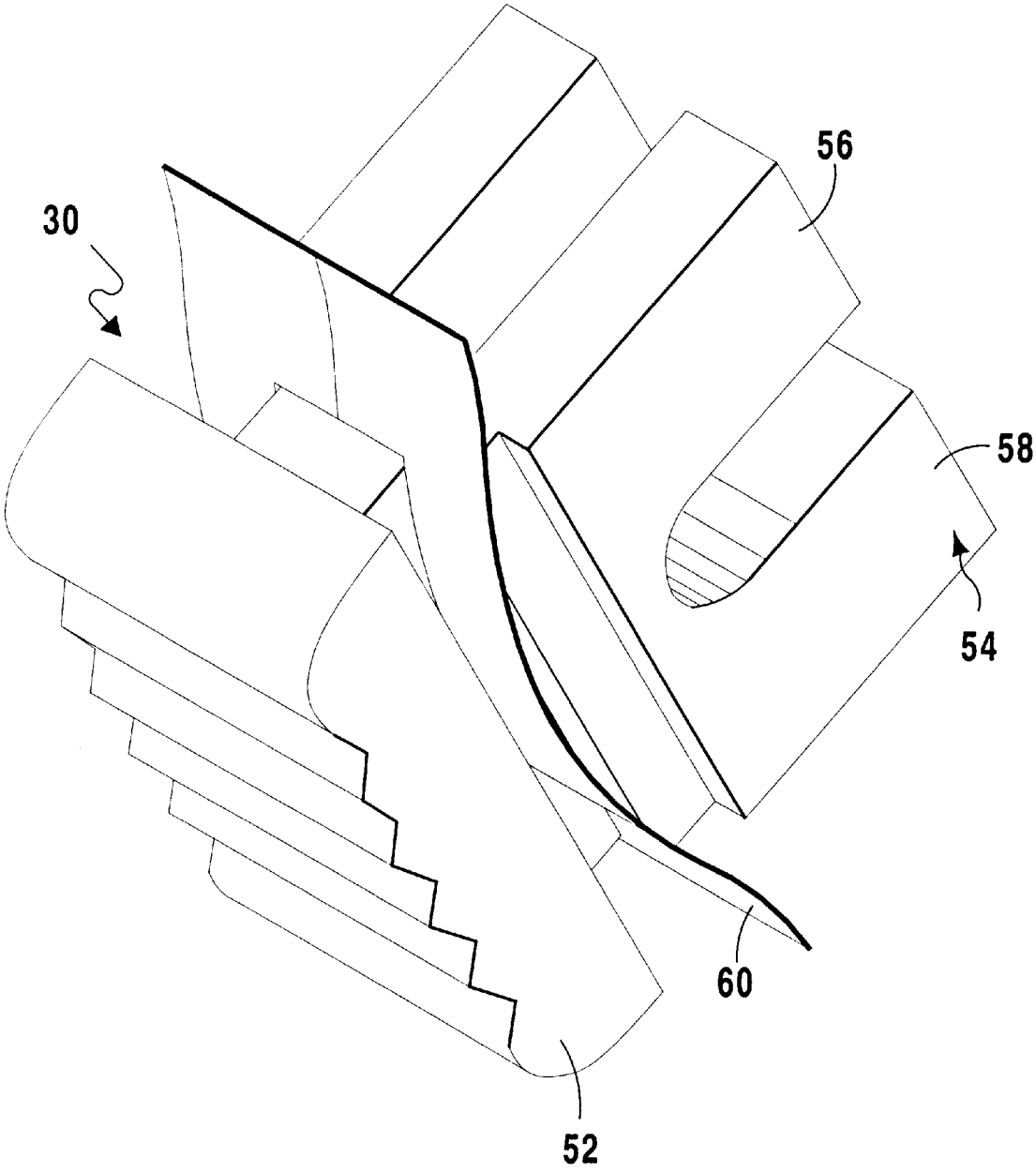
Figure 3A:
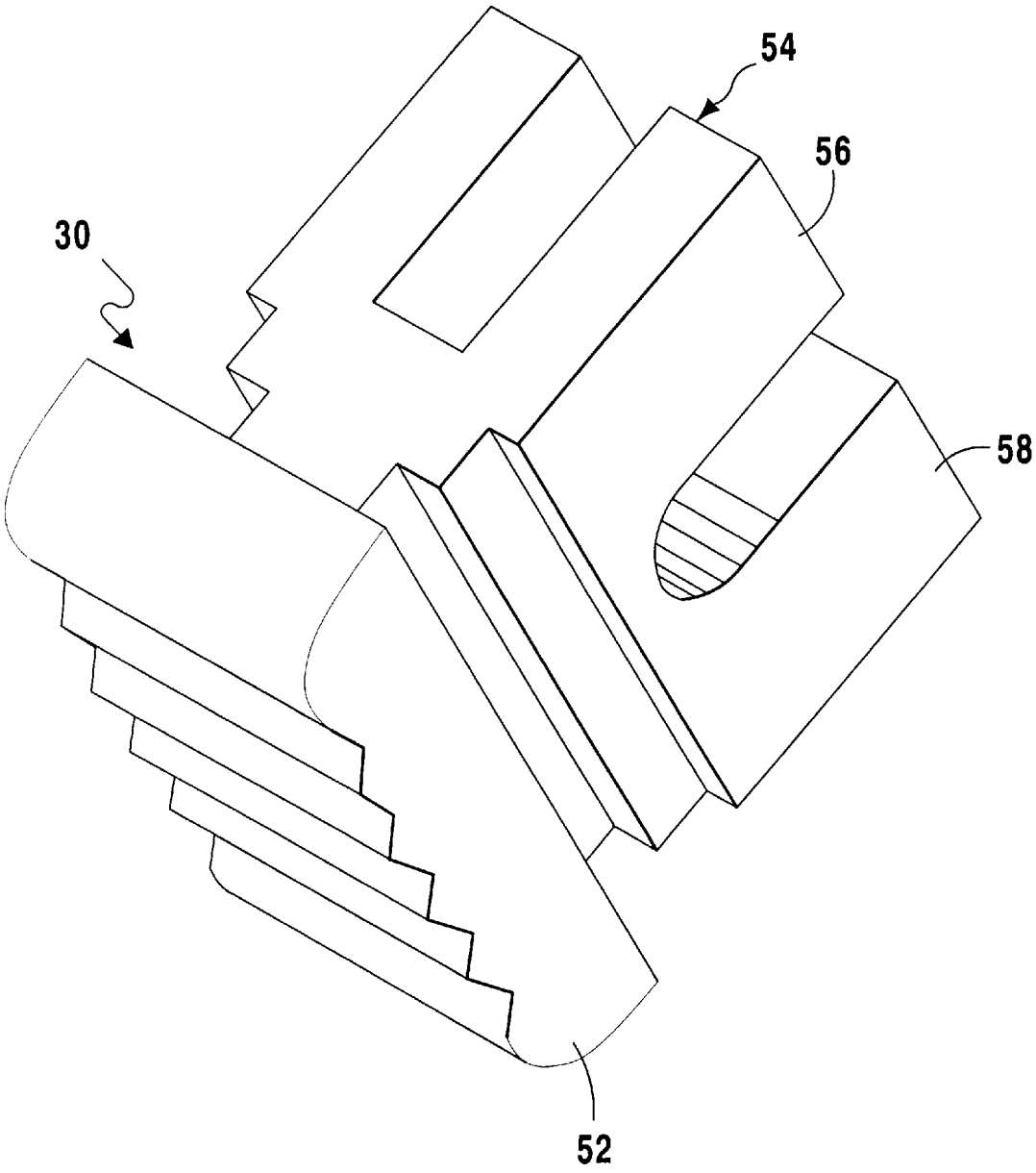
Figure 3B:
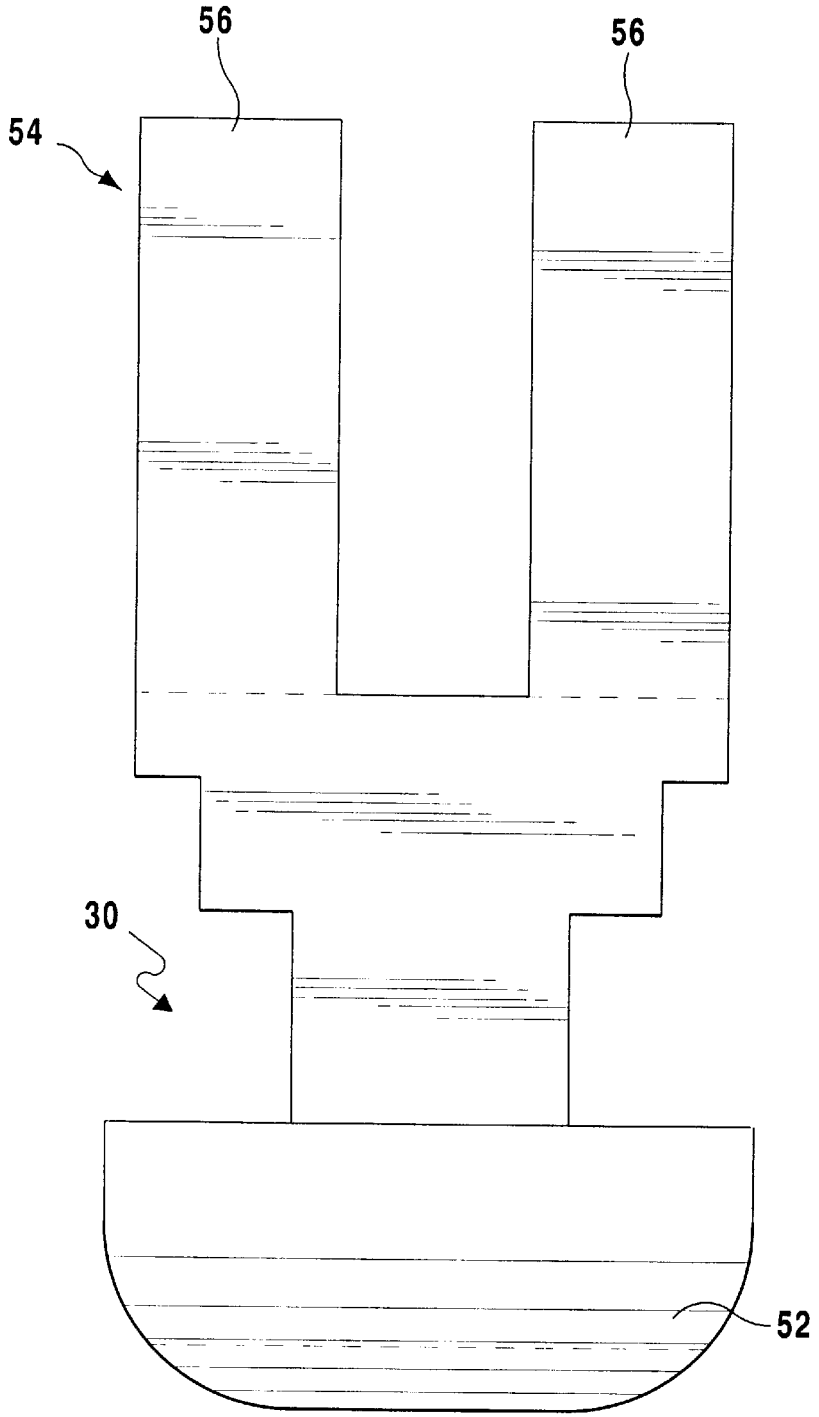
Figure 3C:
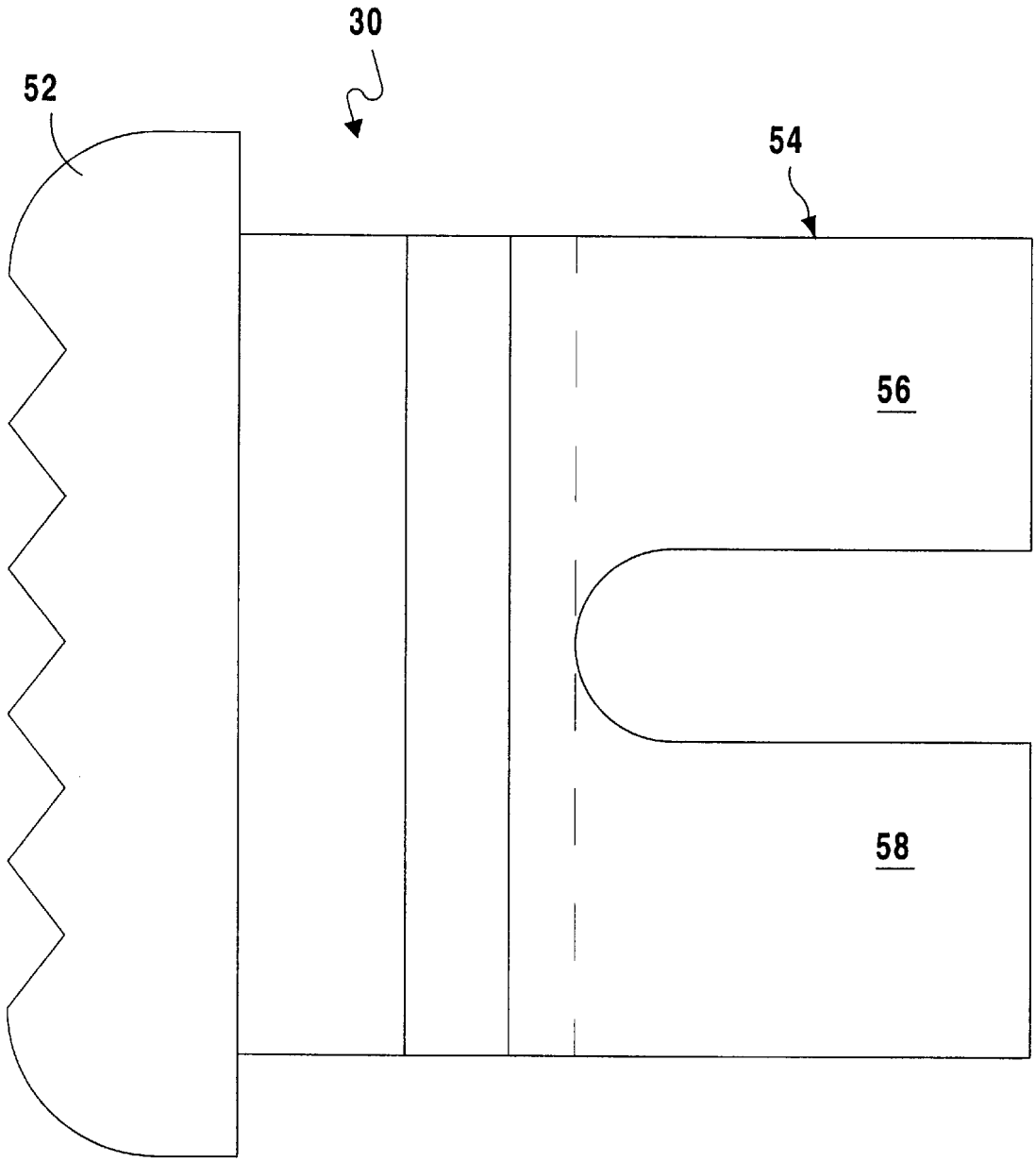
Figure 3D:
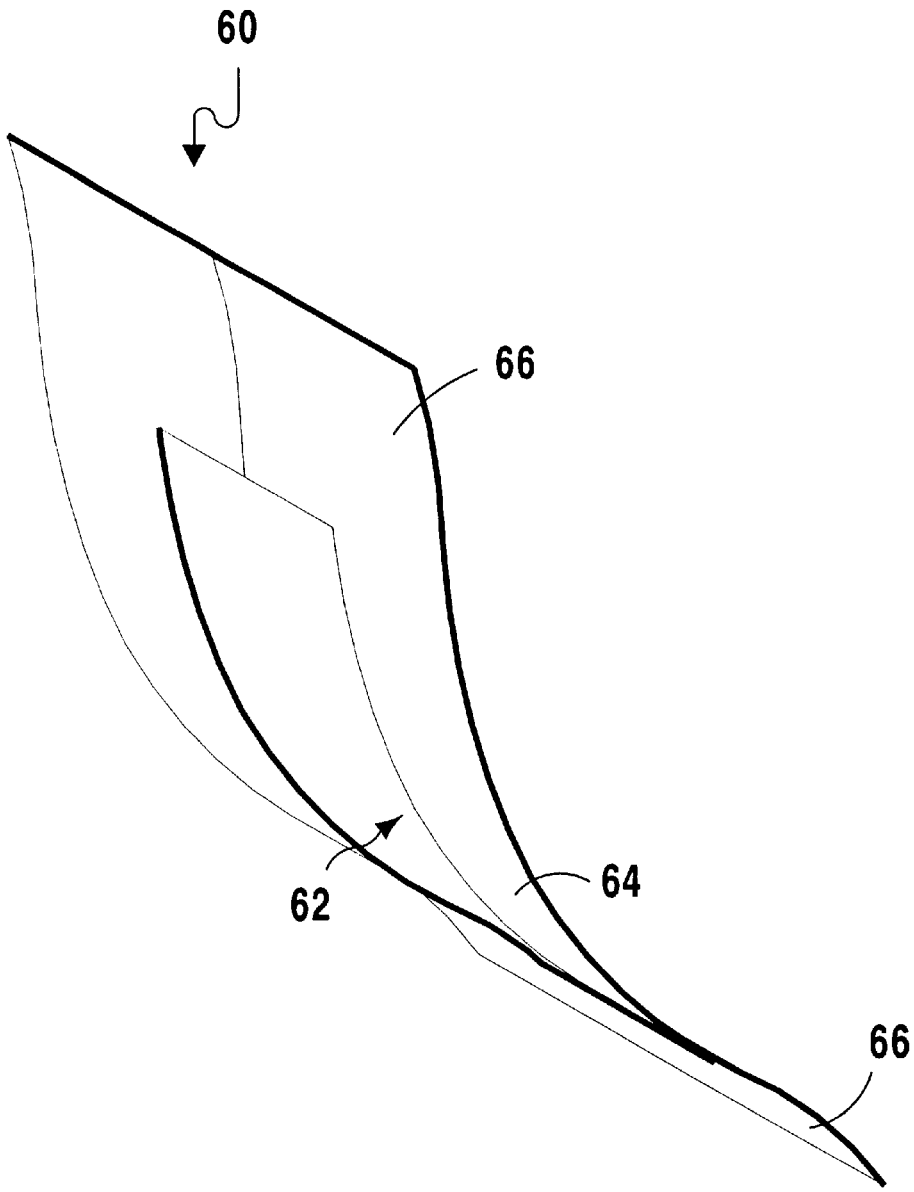
Figure 4:
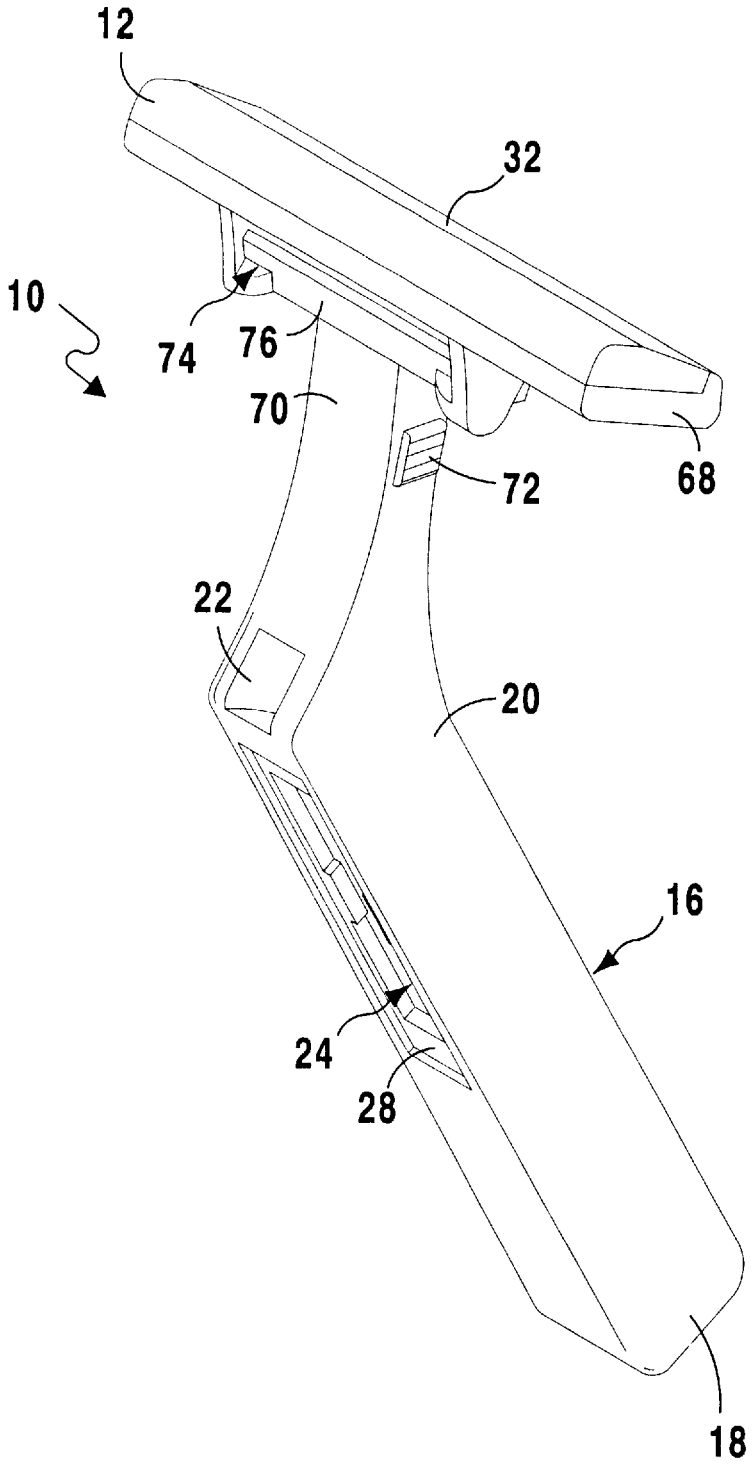
Figure 5:
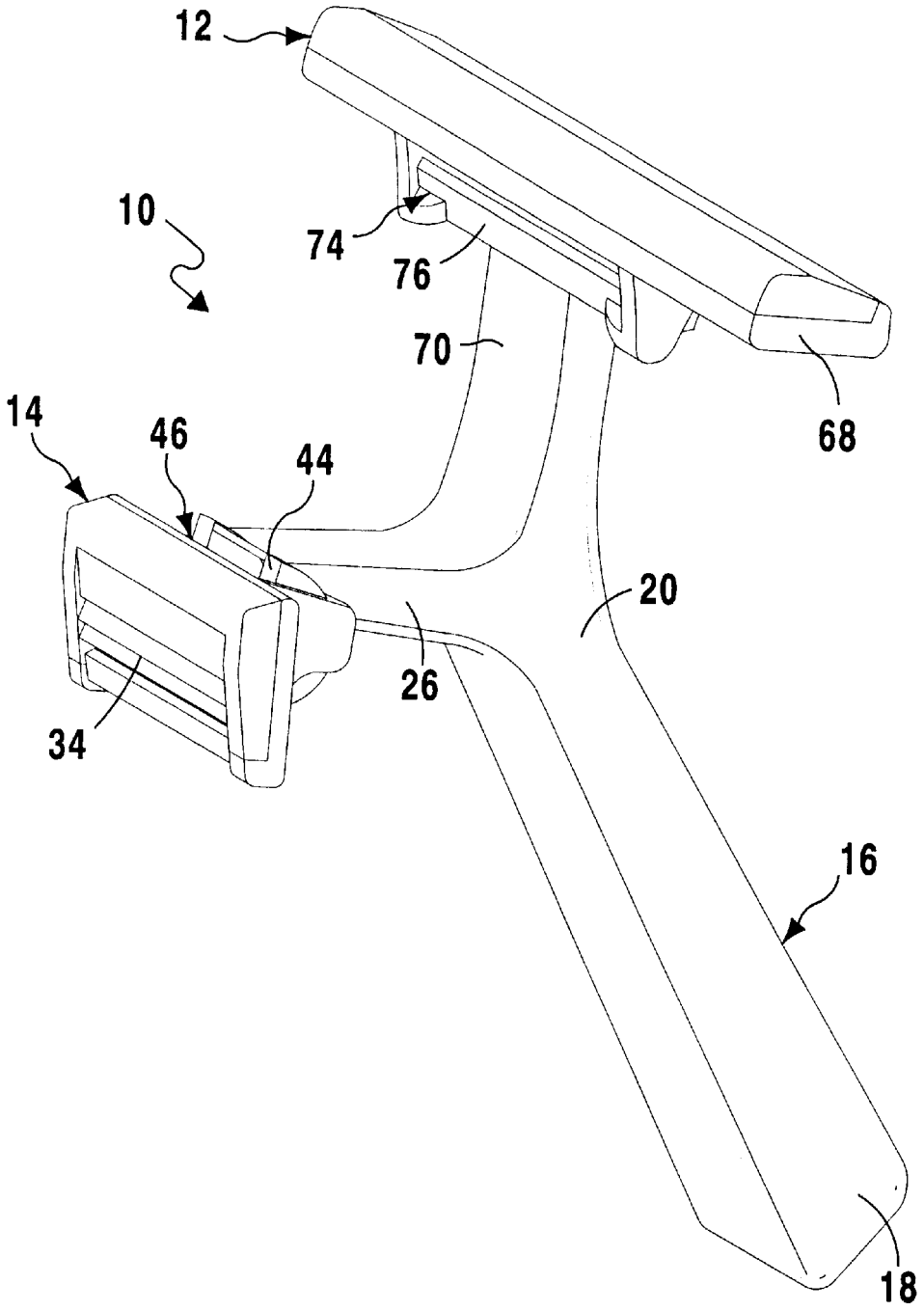
Figure 6:
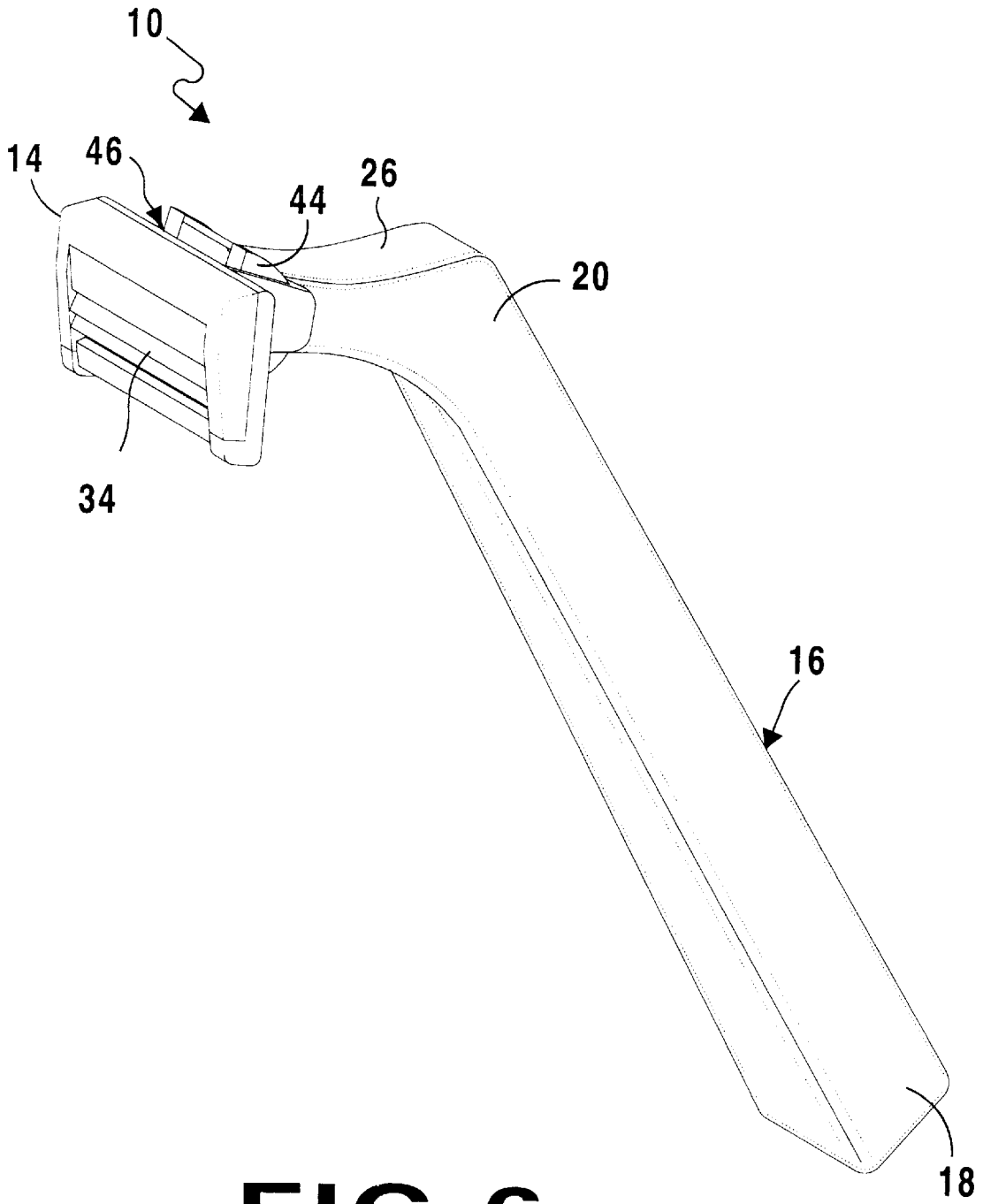

FIG. 2 a top perspective view of the second razor head of the razor of the present invention;

FIG. 3 is a side perspective view of the slideable member for retracting and extending the second razor head and a retention clip of the razor of the present invention;

FIG. 3A is a side perspective view of the slideable member for retracting and extending the second razor head of the razor of the present invention;

FIG. 3B is a top view of the slideable member for retracting and extending the second razor head of the razor of the present invention;

FIG. 3C is a side view of the slideable member for retracting and extending the second razor head of the razor of the present invention;

FIG. 3D is a side perspective view of the retention clip of the razor of the present invention;

FIG. 4 is a top perspective view of the first razor head of the razor of the present invention showing the compartment entrance for placement of the second razor head;

FIG. 5 is a top perspective view of a second embodiment of the razor of the present invention wherein the second razor head is not retractable; and FIG. 6 is a top perspective view of a third embodiment of the razor of the present invention in which the second razor head is connected to an elongated handle.

DESCRIPTION OF THE REFERENCED NUMERALS

Turning now descriptively to the drawings, in which similar reference characters denote similar elements throughout the several views, the Figures illustrate the razor of the present invention. With regard to the reference numerals used, the following numbering is used throughout the various drawing figures.

10 razor of the present invention
12 first standard size razor head
14 second narrow size razor head
16 handle
18 base section of handle
20 top end of base section
22 recess in top side of base section
24 compartment extending through base section
26 telescopic handle extending from second narrow size razor head
28 lengthwise recess in base section
30 slideable member
32 dual blade of first standard size razor head
34 dual blade of second narrow size razor head
36 arrow indicating direction of movement of second narrow size razor head into extended position
38 arrow indicating direction of movement of second narrow size razor head into retracted position
40 blade member
42 blade release button
44 track
46 top side of the telescopic handle
48 bottom side of telescopic handle
50 protrusion
52 gripping member
54 receiving member
56 leg of "U"-shaped receiving member
58 leg of "U"-shaped receiving member
60 clip
62 recess extending through center of clip
64 curved mid section of clip
66 ends of clip
68 razor head
70 angled portion of first standard size razor head
72 blade release button
74 track
76 top side of angled portion

DETAILED DESCRIPTION OF THE PREFERRED EMBODIMENT

Turning now descriptively to the drawings, in which similar reference characters denote similar elements throughout the several views, FIGS. 1 through 6 illustrate the razor of the present invention which is indicated generally by the numeral 10.

Figure 1:
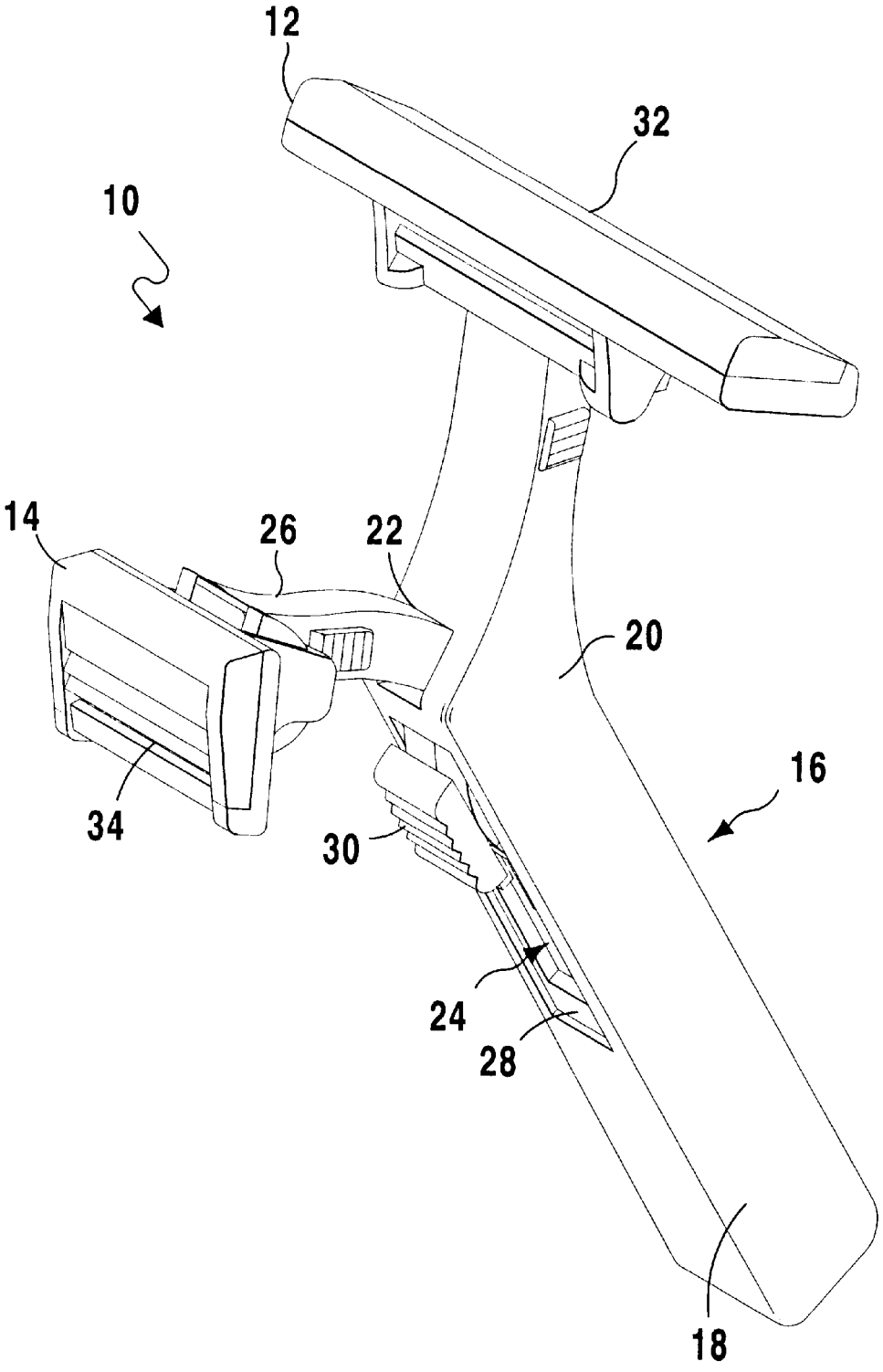
FIG. 1 is a top perspective view of a first embodiment of the razor of the present invention.
Figure 1A:
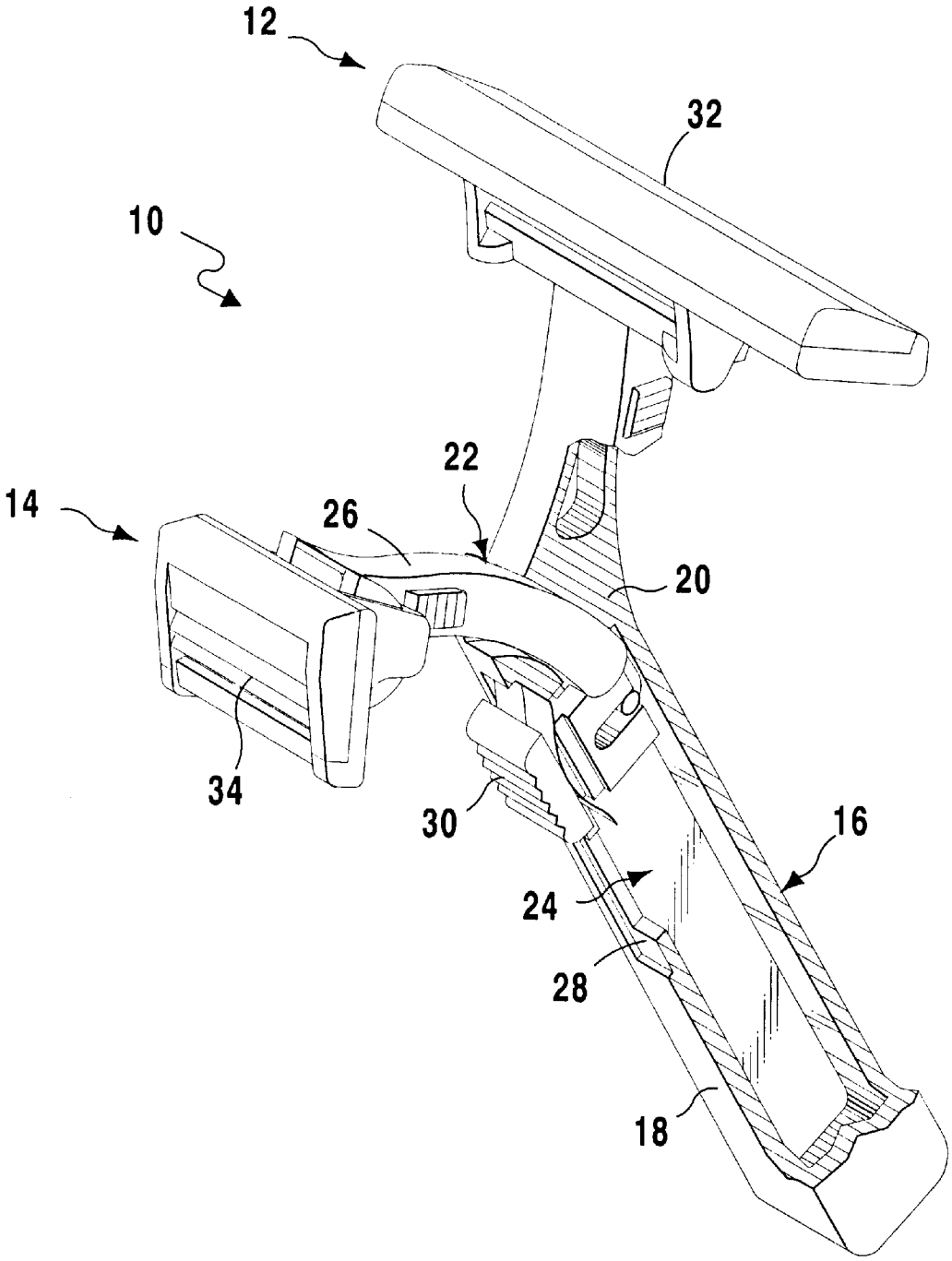
FIG. 1A is a top perspective view of the razor of the present invention showing the handle in partial cross-section.

The razor 10 is shown in FIG. 1 and includes a first standard size head 12 and a second narrow size head 14. The first standard size head 12 is integrally connected to a handle 16. The handle 16 is used to grip the razor 10 and includes a base section 18 having a top end 20. The first standard size head 12 is integrally connected to the handle 16 and extends from the top end 20 at an angle. A recess 22 is also positioned at the top end 20. The recess 22 leads to a compartment 24 extending at least partially through the length of the base section 18. The second narrow size head 14 includes a telescopic handle 26 extending therefrom which extends through the recess 22 and is received within the compartment 24. The telescopic handle 26 is slideable within the recess 24 thus causing the second narrow size head 14 to be movable between a retracted and an extended position. A lengthwise recess 28 extends along the length of the base section 18 and leads to the compartment 24. A slideable member 30 is connected to the telescopic handle 26 and extends through the lengthwise recess 28 and into the compartment 24. The slideable member 30 is used to manually slide the telescopic handle 26 along the length of the compartment 24 causing the second narrow sized head 14 to move between its extended position and retracted position.

The first standard size razor head 12 preferably includes a dual blade 32 positioned therein for use in shaving hair and stubble from a particular desired area of the body. Alternatively, the first standard size razor head 12 may include any other number of blades as long as the desired purpose of removing hair from a desired area is achieved.

While a preferred structure for the shaving blades of the first standard size razor head is shown and described herein, those of ordinary skill in the art who have read this description will appreciate that there are numerous other structures for the shaving blades and, therefore, as used herein the phrase "means for shaving a desired area connected to said first razor head" should be construed as including all such structures as long as they achieve the desired result of shaving the desired area, and therefore, that all such alternative mechanisms are to be considered as equivalent to the one described herein.

The second narrow size razor head 14 also preferably includes a dual blade 34 positioned therein for use in trimming hair, sculpting desired areas of hair and shaving sensitive areas such as around the nose and ears. Alternatively, the second narrow size razor head 14 may include any other number of blades as long as the desired purpose of removing hair from a desired area is achieved.

While a preferred structure for the shaving blades of the second narrow size razor head is shown and described herein, those of ordinary skill in the art who have read this description will appreciate that there are numerous other structures for the shaving blades and, therefore, as used herein the phrase "means for shaving a desired area connected to said second razor head" should be construed as including all such structures as long as they achieve the desired result of shaving the desired area, and therefore, that all such alternative mechanisms are to be considered as equivalent to the one described herein.

A perspective view of the razor 10 of the present invention is shown in Figure IA with the handle 16 illustrated in cross-section. From this view, the compartment 24 can be clearly seen with the telescopic handle 26 partially positioned therein such that the second narrow size razor head 14 is in an extended position. In this position, the slideable member 30 is locked in position at a top end of the lengthwise recess 28 and holds the second narrow size razor head 14 in the extended position. The remainder of the compartment 24 is empty. When in its extended position the second narrow size head 14 is ready for use.

Figure 1B:
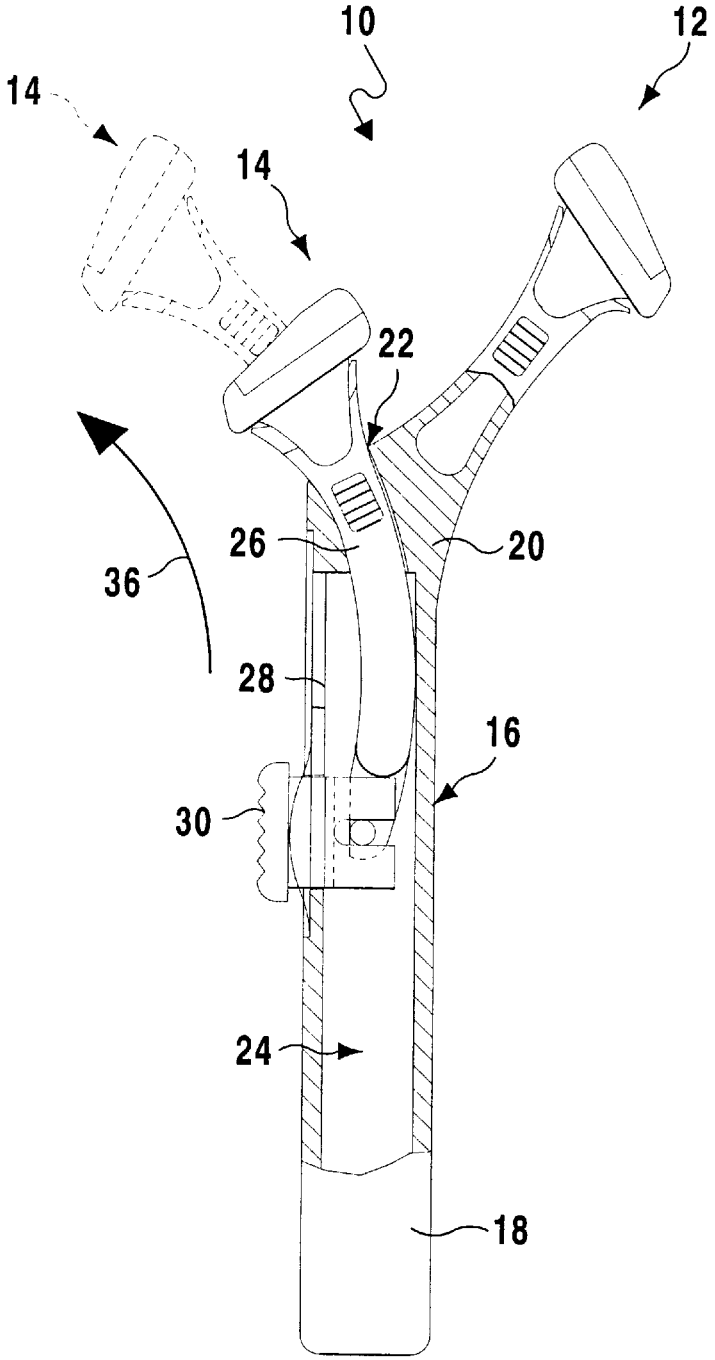
FIG. 1B is a side view of the razor of the present invention showing the handle in partial cross-section and the second razor head in a fully retracted position.

FIG. 1B shows a side view of the razor 10 in partial cross-section with the second narrow size razor head 14 in a retracted position. In this position, the slideable member 30 is seated at a base of the lengthwise recess 28 and the telescopic handle 26 is substantially fully received within the compartment 24. When the slideable member 30 is caused to move towards the top of the lengthwise recess 28, the second narrow size razor head 14 is caused to move in the direction of the arrow labeled 36 and into an extended position as illustrated by the dashed outline of the second narrow size razor head 14. As the slideable member 30 is moved in this direction the telescopic handle 26 is caused to exit the compartment 24 through the recess 22.

Figure 1C:
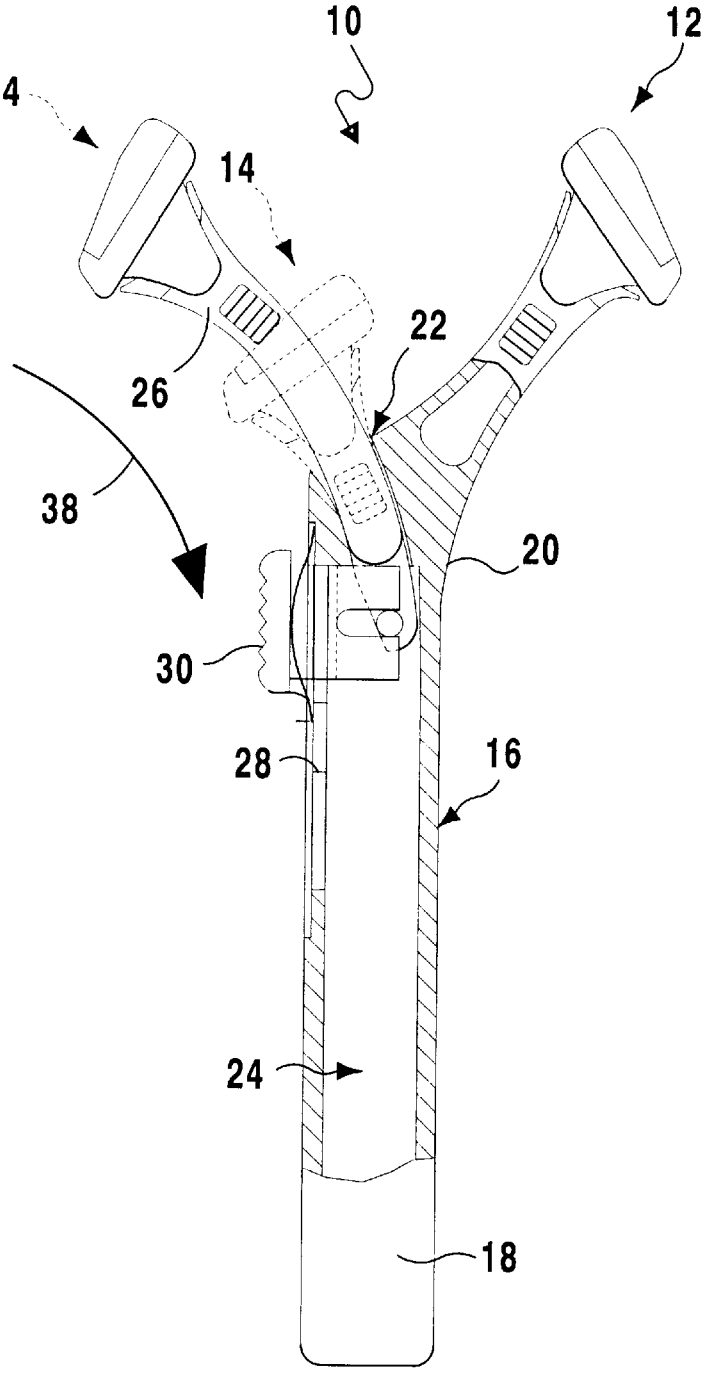
FIG. 1C is a side view of the razor of the present invention showing the handle in partial cross-section and the second razor head in a fully extended position.

FIG. 1C shows a side view of the razor 10 in partial cross-section with the second narrow size razor head 14 in an extended position. In this position, the slideable member 30 is seated at the top of the lengthwise recess 28 and the telescopic member 26 is substantially entirely outside of the compartment 24 and extending above the recess 22. When the slideable member 30 is caused to move towards the bottom of the lengthwise recess 28, the second narrow size razor head 14 is caused to move in the direction indicated by the arrow labeled 38 and into a retracted position as illustrated by the dashed outline of the second narrow size razor head 14. As the slideable member 30 is moved in this direction the telescopic member 26 is caused to enter the compartment 24 through the recess 22.

A perspective view of the second narrow size razor head 14 separate from the razor 10 of the present invention is illustrated in FIG. 2. As can be seen from this figure, the second narrow size razor head 14 includes a razor head 40 including a dual blade 34 extending from the telescopic member 26. On either side of the telescopic member 26 is a blade release button 42 for releasing the blade head from its connection to the telescopic member 26. The blade member 40 is also pivotal along a track 44 on a top side 46 of the telescopic member 26. Extending from a bottom side 48 of the telescopic member 26 is a protrusion 50 which is connected to the slideable member 30. When the second narrow size razor head 14 is moved between the extended and retracted positions the protrusion 50 is caused to ride with the slideable member 30 along the length of the lengthwise recess 28.

An enlarged perspective view of the slideable member is illustrated in FIG. 3. The slideable member 30 includes a gripping portion 52 which extends through the lengthwise recess 28 and outside of the handle 16 and a receiving portion 54 extending from the gripping portion 52 and into the compartment for receiving the protrusion 50. The receiving portion 54 is preferably formed by a pair of "U"-shaped members whereby the protrusion is received between the legs 56, 58 of the pair of "U"-shaped members. A clip 56 is positioned between the gripping portion 52 and the receiving portion 54 providing a frictional force between the slideable member 30 and the handle 16 for securing the positioning of the second narrow size razor head 14 and preventing the second narrow size razor head 14 from sliding along the lengthwise recess 28 during use. FIG. 3A illustrates the slideable member 30 shown in FIG. 3 without the clip 60 positioned between the gripping portion 52 and the receiving portion 54. FIG. 3B illustrates a top view of the slideable member 30 without the clip 60 positioned between the gripping portion 52 and the receiving portion 54. A side view of the slideable member 30 without the clip 60 positioned between the gripping portion 52 and the receiving portion 54 is illustrated in FIG. 3C.

A perspective view of the clip 60 is illustrated in FIG. 3D. The clip 60 is formed with a recess 62 extending through a central portion thereof. The slideable member 30 extends through the recess 62 whereby the gripping portion extends on one side of the clip 60 and the receiving portion extends on the opposing side of the clip 60. The clip 60 is formed to have a hump shape whereby the mid section 64 is rounded for contacting the gripping member 52. The ends 66 of the clip 60 contact and exert a force against the handle 16. The mid section 64 of the clip 60 exerts a force against the gripping member 52 causing the user to apply a pressure to the gripping member 52 in order to slide the slideable member 30 along the length of the lengthwise recess 28 and also causing the slideable member to hold the second narrow size razor head in either the extended position, retracted position or any position therebetween.

A top perspective view of the razor 10 of the present invention with the second narrow size razor head 14 removed from its position extending into the compartment 24 is illustrated in FIG. 4. As can be seen from this figure, the first standard size razor head 12 includes a razor head 68 having the dual blade 32 extending from an angled portion 70 which extends from the handle 16. On either side of the angled portion 70 is a blade release button 72 for releasing the razor head 68 from its connection to the angled portion 70. The razor head 68 is also pivotal along a track 74 on a top side 76 of the angled portion 70.

FIG. 5 illustrates the razor of the present invention wherein the second narrow size razor head 14 is integrally connected to the handle 16. In this embodiment, the narrow size razor head 14 is not slideable between the extended and retracted positions but remains at a set position extending from the handle 16. The telescopic member 26 is thus secured to the top side 20 of the handle 16.

A razor 10 in accordance with the present invention is illustrated in FIG. 6 wherein only the second narrow size razor head 14 is connected to the handle 16. The second narrow size razor head 14 is integrally connected to the handle 16 and thus, the razor head is not movable between the extended and retracted positions.

The operation of the razor 10 will now be described with reference to the figures. In operation, the razor 10 is adapted for use by the user by sliding the second narrow size razor head 14 in either the extended position if the second narrow razor head 14 is to be used or in the retracted position if the first standard razor head 12 is to be used. This is done by applying pressure to the sliding member 30 and sliding the sliding member 30 along the length of the lengthwise recess 28. This causes the telescopic projection to move within the compartment 24 and thus either extend or retract the second narrow size razor head 14. When the user is shaving with the first standard size razor head 12, the second narrow size razor head 14 should be in the retracted position and thereby not obstructing the shaving of the user. When the user desires to use the second narrow size razor head 14, it should be moved into the extended position allowing the user to readily shave therewith. The user will shave in the conventional manner with either of the first and second razor heads 12 and/or 14 and then clean the razor heads until further shaving is desired. The embodiments illustrated in FIGS. 5 and 6 will be used in the conventional manner to shave an area desired by the user, the narrow size razor head being provided to allow the user to shave sensitive areas and also to allow for accurate sculpting and shaping other areas of hair.

From the above description it can be seen that the razor of the present invention is able to overcome the shortcomings of prior art devices by providing a razor which is able to both sculpt facial hair and shave sensitive areas of the skin. The razor includes a first standard razor head and a second narrow razor head extending from common handle, wherein the first razor head is of standard size for shaving the hair of the user and the second razor head is more narrow than the first razor head for shaving particular areas such as the nose, ears and mustaches and for sculpting other areas of hair. The second razor head of the razor of the present invention may be retractably connected within the handle. The razor also includes a compartment in the handle for receiving the second razor head when the second razor head is in its retracted position and a manually activated clip for retracting the second razor head. Furthermore, the razor of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A razor for shaving and sculpting an area of hair on a user, said razor comprising:

a) a first standard size razor head;

b) a second narrow size razor head including a telescopic member extending therefrom;

c) a handle including a top side integrally connected to said first standard size razor head; a first recess extending through said top side and into said handle forming a compartment; and a second recess extending along a length of said handle and providing access to said compartment, wherein said telescopic member is received by said compartment and is slideable therein; and d) means connected to said telescopic member and extending through said second recess for sliding said telescopic member within said compartment whereby movement of said means for sliding moves said second narrow size razor head between a first extended position in which said telescopic member extends substantially totally from said compartment and a second retracted position in which said telescopic member being substantially completely received within said compartment.

2. The razor as recited in claim 1, wherein said telescopic member includes a protrusion on an end opposite said second narrow razor head and said means for sliding includes means for receiving said protrusion and guiding said telescopic member along the length of said compartment.

3. The razor as recited in claim 2, wherein said means for sliding includes a gripping member extending from said means for receiving and through said second recess, whereby exertion of a force on said gripping member by the user causes said sliding means to move along the length of said second recess carrying said second narrow size razor head therewith.

4. The razor as recited in claim 3, further comprising a clip including a recess extending through a central portion thereof, said sliding member extending through said recess such that said gripping member and means for receiving are positioned on opposing sides of said recess.

5. The razor as recited in claim 4, wherein said clip is positioned to exert a force on both said gripping member and said handle and thereby create a frictional force therebetween.

6. The razor as recited in claim 5, wherein said frictional force maintains said telescopic member in position within said compartment.

7. The razor as recited in claim 1, wherein said second narrow size razor head includes a first razor blade releasably connected to said telescopic member and said telescopic member includes means for releasing said razor blade from the second narrow size razor head.

8. The razor as recited in claim 1, wherein said first razor blade includes a double edged blade.

9. The razor as recited in claim 1, wherein said first standard size razor head includes an angled portion extending from said handle and a second razor blade releasably connected thereto.

10. The razor as recited in claim 9, wherein said angled portion further includes means for releasing said second razor blade from the first standard size razor head.

11. The razor as recited in claim 8, wherein said first razor blade is pivotally connected to said telescopic member.

12. The razor as recited in claim 10, wherein said second razor blade is pivotally connected to said angled portion.

* * * * *